US008223111B2

(12) United States Patent
Liao et al.

(10) Patent No.: US 8,223,111 B2
(45) Date of Patent: Jul. 17, 2012

(54) DISPLAY DEVICE PROVIDING BI-DIRECTIONAL VOLTAGE STABILIZATION

(75) Inventors: Yi-Suei Liao, Hsin-Chu (TW); Chien-Liang Chen, Hsin-Chu (TW); Ming-Yen Tsai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 419 days.

(21) Appl. No.: 12/560,443

(22) Filed: Sep. 16, 2009

(65) Prior Publication Data

US 2010/0231497 A1 Sep. 16, 2010

(30) Foreign Application Priority Data

Mar. 13, 2009 (TW) ..... 98108241 A

(51) Int. Cl.
*G09G 3/36* (2006.01)

(52) U.S. Cl. ..... 345/100; 345/87

(58) Field of Classification Search ..... None
See application file for complete search history.

(56) References Cited

U.S. PATENT DOCUMENTS 6,970,274 B2 * 11/2005 Morita et al. ..... 358/474
7,456,913 B2 11/2008 Tai et al.
7,796,104 B2 * 9/2010 Kim ..... 345/87
7,936,332 B2 * 5/2011 Lee et al. ..... 345/100
2003/0090447 A1 * 5/2003 Kimura ..... 345/82
2006/0061535 A1 3/2006 Kim et al.

FOREIGN PATENT DOCUMENTS

JP H07175083 A 7/1995
JP 200255644 A 2/2002
JP 2002133890 A 5/2002
JP 2007241027 A 9/2007
JP 2008146079 A 6/2008
JP 2008262071 A 10/2008

* cited by examiner

*Primary Examiner* — Jason Olson

(74) *Attorney, Agent, or Firm* — Winston Hsu; Scott Margo

(57) ABSTRACT

An LCD device includes a plurality of gate lines and a plurality of shift register units for driving corresponding gate lines. Each shift register unit includes a first circuit and a second circuit. The first circuit, disposed on a first side of a corresponding gate line, includes a pulse generator and a first transistor having a first W/L ratio. The pulse generator provides a driving signal according to the voltage obtained at a node, while the first transistor maintains the voltage level of the node. The second circuit, disposed on a second side of the corresponding gate line, includes a second transistor having a second W/L ratio. The second transistor maintains the voltage level of the driving signal from the second side of the corresponding gate line. The first W/L ratio is smaller than the second W/L ratio, and the first circuit occupies larger space than the second circuit.

20 Claims, 10 Drawing Sheets

DISPLAY DEVICE PROVIDING BI-DIRECTIONAL VOLTAGE STABILIZATION

BACKGROUND OF THE INVENTION

1. Field of the Invention

The present invention is related to a display device, and more particularly, to a liquid crystal display device having bi-direction voltage stabilization mechanism.

2. Description of the Prior Art

Liquid crystal display (LCD) devices, characterized in low radiation, thin appearance and low power consumption, have gradually replaced traditional cathode ray tube display (CRT) devices and widely used in electronic devices such as notebook computers, personal digital assistants (PDAs), flat panel TVs or mobile phones. Traditional LCD devices display images by driving the pixels of the panel using external driving chips. In order to reduce the number of devices and to lower manufacturing cost, gate on array (GOA) technique has been developed, in which gate drivers are directly fabricated on the panel where the pixels are disposed.

Reference is made to FIG. 1 for a top-view diagram of a related art LCD device 100. The LCD device 100, fabricated using GOA technique, includes a display area 180 and a non-display area 190. A shift register 110, a source driver 130, a clock generator 140 and a power supply 150 are disposed in the non-display area 190 for driving the pixels (not shown in FIG. 1) in the display area 180 in order to display images.

Reference is made to FIG. 2 for a simplified block diagram of the LCD device 100. FIG. 2 merely depicts a partial structure of the LCD device 100, including a plurality of gate lines GL(1)~GL(N) disposed in the display area 180, as well as the shift register 110, the clock generator 140, and the power supply 150 disposed in the non-display area 190. The clock generator 140 can provide a start pulse signal VST and clock signals CLK1-CLKm for operating the shift register 110. The power supply 150 can provide a bias voltage VSS for operating the shift register 110. The shift register 110 includes a plurality of serially-coupled shift register units SR(1)-SR(N), which include pulse generators PG(1)-PG(N) and low level stabilizer LLS(1)-LLS(N), respectively. The output ends of the shift register units SR(1)-SR(N) are respectively coupled to the first ends L(1)-L(N) of the corresponding gate lines GL(1)-GL(N). Based on the clock signals CLK1-CLKm and the start pulse signal VST, the shift register 110 can sequentially output gate driving signals GS(1)-GS(N) to the corresponding gate lines GL(1)-GL(N) via the shift register units SR(1)-SR(N), respectively.

Reference is made to FIG. 3 for a diagram illustrating a related art nth-stage shift register unit SR(n) among the plurality of shift register units SR(1)-SR(N), wherein n is an integer between 1 and N. The shift register unit SR(n) includes a pulse generator PG(n) and a low level stabilizer LLS(n). The input end of the shift register unit SR(n) is coupled to the output end of a prior-stage shift register unit SR(n−1). The output end of the shift register unit SR(n) is coupled to the first end L(n) of the gate line GL(n).

The pulse generators PG(n), including transistors T1, T2, T9 and T10, can generate gate driving signal GS(n) based on the clock signal CLKn and the gate driving signal GS(n−1) transmitted from the prior-stage shift register unit SR(n−1). The low level stabilizer LLS(n) includes transistors T3, T4 and T11-T14. The transistors T11-T14 form a pull-down control circuit 11 which can output control signals to the gates of the transistors 13 and T4 based on the clock signal CLKn and the voltage level of the node Q(n). Therefore, based on respective gate voltages, the transistor T3 can control the signal transmission path between the node Q(n) and the low-level bias voltage VSS, while the transistor T4 can control the signal transmission path between the first end L(n) of the gate line GL(n) and the low-level bias voltage VSS.

As shown FIG. 1, the pulse generator PG(n) and the low level stabilizer LLS(n) of the shift register unit SR(n) are both disposed in the non-display area 190 and on the same side with respect to the display area 180. During the output period of the shift register unit SR(n), the gate line GL(n) of the related art LCD device 100 receives the gate driving signal GS(n) generated by the pulse generators PG(n) at the first end L(n); during other periods excluding the output period of the shift register unit SR(n), the voltage level of the gate line GL(n) in the related art LCD device 100 is maintained using the transistors T3 and T4 of the low-level stabilizer LLS(n). The related art LCD device 100 adopts a uni-directional voltage stabilizing structure, in which the node Q(n) is pulled down to the low-level bias voltage VSS via the turned-on transistor T3, thereby turning off the transistor T2 and preventing the first end L(n) of the gate line GL(n) from being influenced by the clock signal CLKn. Meanwhile, the first end L(n) of the gate line GL(n) is pulled down to the low-level bias voltage VSS via the turned-on transistor T4, thereby keeping the gate driving signal GS(n) at the low level from the signal input side.

In the driving circuits of an LCD device, the channel width/length ratio of a transistor is determined based on how much driving is required. A transistor having a larger channel width/length ratio provides higher driving capability, but occupies larger circuit space. The pull-down circuit 11 generally adopts the transistors T11-T14 with small channel width/length ratio, which can provide sufficient driving for generating the control signals of the transistor T3. Therefore, when performing miniaturization or rim reduction in the LCD device, the major impact on panel size is mainly contributed by the channel width/length ratios $W/L_1$~$W/L_4$ of the transistors T1-T4.

In the related art LCD device 100, since the pulse generator PG(n) receives the input signal using the transistor T1 and outputs the gate driving signal GS(n) for driving the gate line GL(n) using the transistor T2, the transistor T2 needs to provide much higher driving capability than the transistor T1. Since the low-level stabilizer LLS(n) maintains the voltage level of the node Q(n) using the transistor T3 and maintains the voltage level of the entire output using the transistor T4, the transistor T4 needs to provide much higher driving capability than the transistor T3. Generally, $W/L_1$ is about 300, $W/L_2$ is about 2000, $W/L_3$ is about 40, and $W/L_4$ is about 300. The capacitor $C_D$ in FIG. 3 may be a parasitic capacitor of the largest transistor T1.

As shown in FIG. 1, the non-display area around the display area includes dummy space regardless of the position of the driving circuits. The related art LCD device 100 adopts a uni-directional driving and stabilizing structure, in which the pulse generator PG(n) and the low-level stabilizer LLS(n) of the shift register unit SR(n) are both disposed in the dummy space of the non-display area 190 at the same side with respect to the display area 180. Since the transistors T1-T4 occupy large circuit space, rim reduction cannot be effectively performed on the LCD device 100.

SUMMARY OF THE INVENTION

The present invention provides an LCD device having bi-directional stabilization mechanism comprising a display area in which a plurality of parallel gate lines are disposed; a non-display area having a first area and a second area, wherein the first and second areas are located on opposite sides with respect to the display area; a shift register having a plurality of shift register units coupled in series, wherein a shift register among the plurality of shift register drives a corresponding gate line among the plurality of gate lines. The shift register units comprises a first circuit disposed in the first area and a second circuit disposed in the second area. The first circuit comprises a pulse generator for generating a driving signal based on an input signal and comprising an input end for receiving the input signal, an output end coupled to a first end of the corresponding gate line for outputting the driving signal, and a node; a first transistor having a first channel width/length ratio for maintaining a voltage level of the node based on a first control signal and comprising a first end coupled to the node, a second end for receiving a first voltage, and a control end for receiving the first control signal. The second circuit comprises a second transistor having a second channel width/length ratio for maintaining a voltage level at a second end of the corresponding gate line based on a second control signal and comprising a first end coupled to the second end of the corresponding gate line, a second end for receiving a second voltage, and a control end for receiving the second control signal. The first channel width/length ratio is smaller than the second channel width/length ratio and the layout area of the first circuit is larger than the layout area of the second circuit.

The present invention further provides a shift register which provides bi-directional stabilization mechanism and includes a plurality of shift register units coupled in series for driving a plurality of loads. A shift register among the plurality of shift register comprises a first circuit disposed in the first area and a second circuit disposed in the second area. The first circuit comprises a pulse generator for generating a driving signal based on an input signal and comprising an input end for receiving the input signal, an output end coupled to a first end of a corresponding load among the plurality of loads for outputting the driving signal, and a node; a first transistor having a first channel width/length ratio for maintaining a voltage level of the node based on a first control signal and comprising a first end coupled to the node, a second end for receiving a first voltage, and a control end for receiving the first control signal. The second circuit comprises a second transistor having a second channel width/length ratio for maintaining a voltage level at a second end of the corresponding load based on a second control signal and comprising a first end coupled to the second end of the corresponding load, a second end for receiving a second voltage, and a control end for receiving the second control signal. The first channel width/length ratio is smaller than the second channel width/length ratio and the layout area of the first circuit is larger than the layout area of the second circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
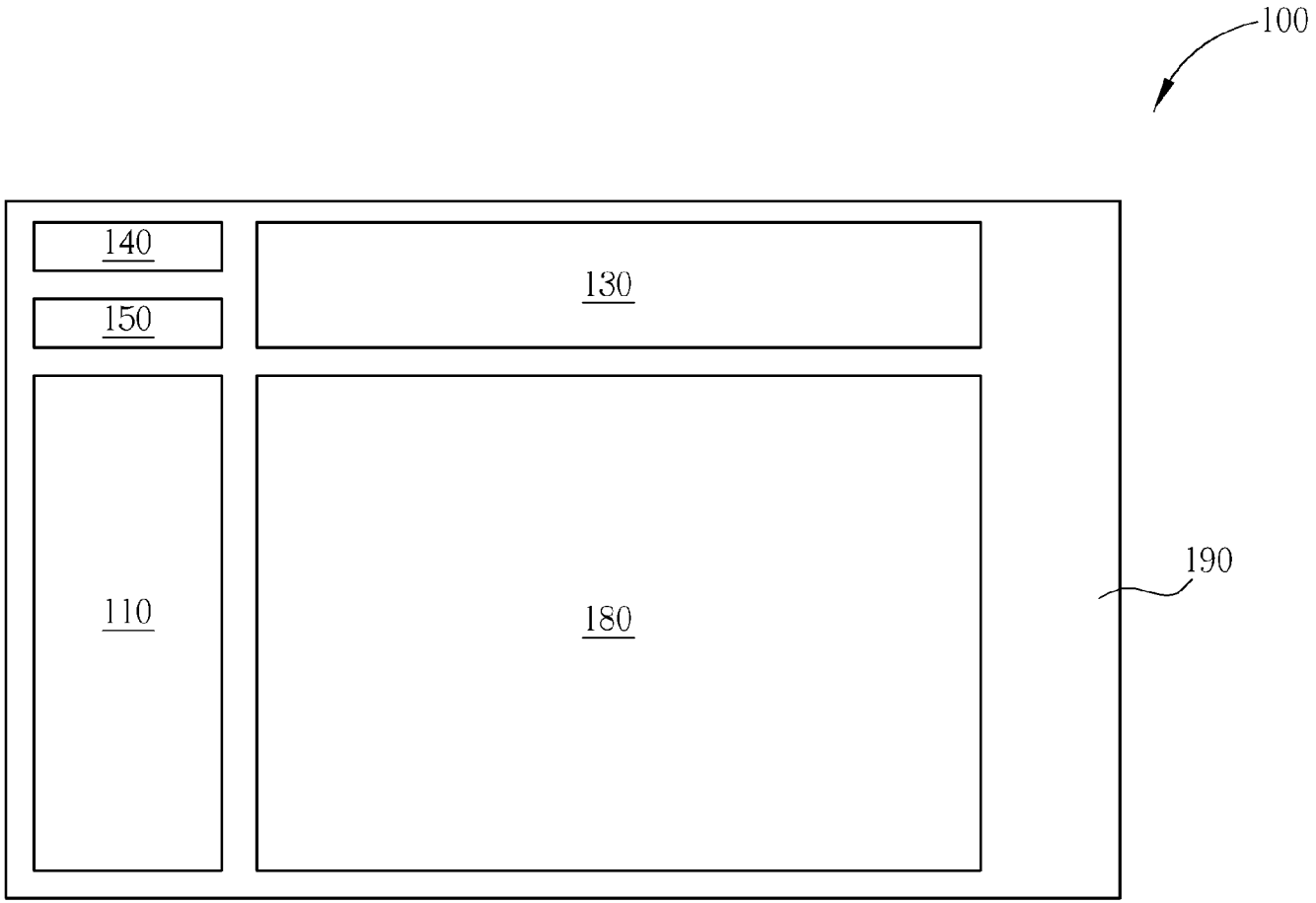
FIG. 1 RELATED ART
FIG. 1 is a top-view diagram of a related art LCD device.
Figure 2:
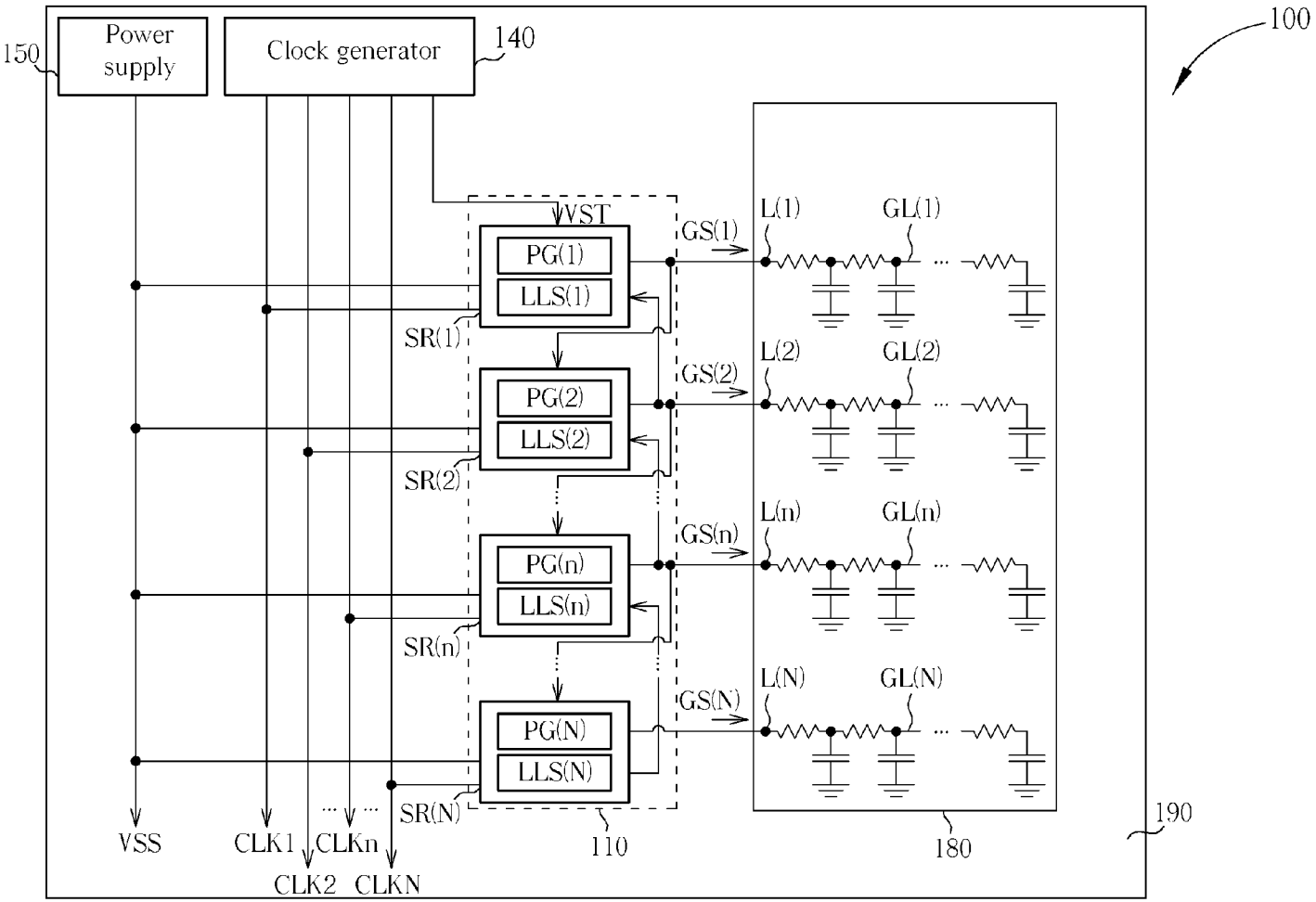
FIG. 2 RELATED ART
FIG. 2 is a simplified block diagram of a related art LCD device.
Figure 3:
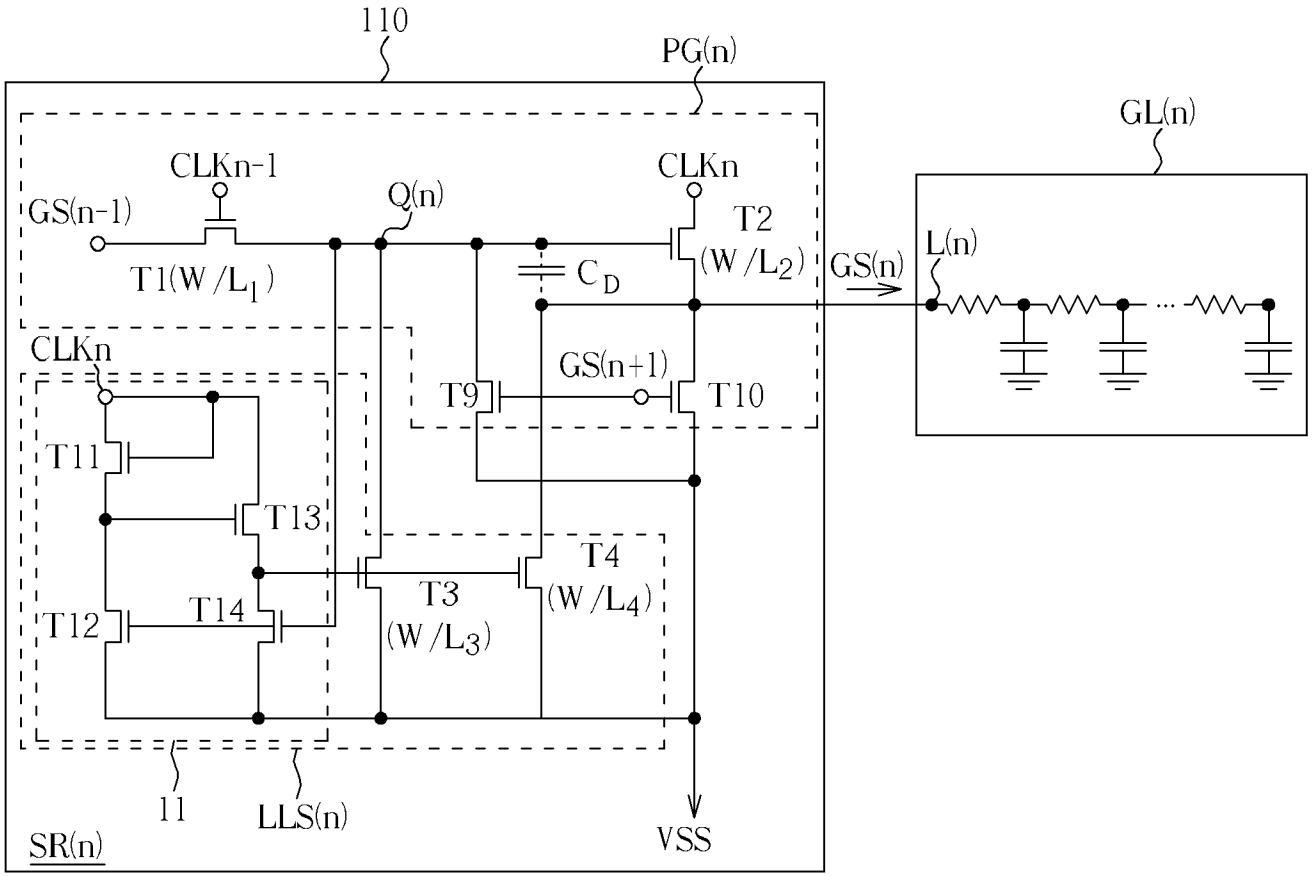
FIG. 3 RELATED ART
FIG. 3 is a diagram illustrating a related art nth-stage shift register unit.
Figure 4:
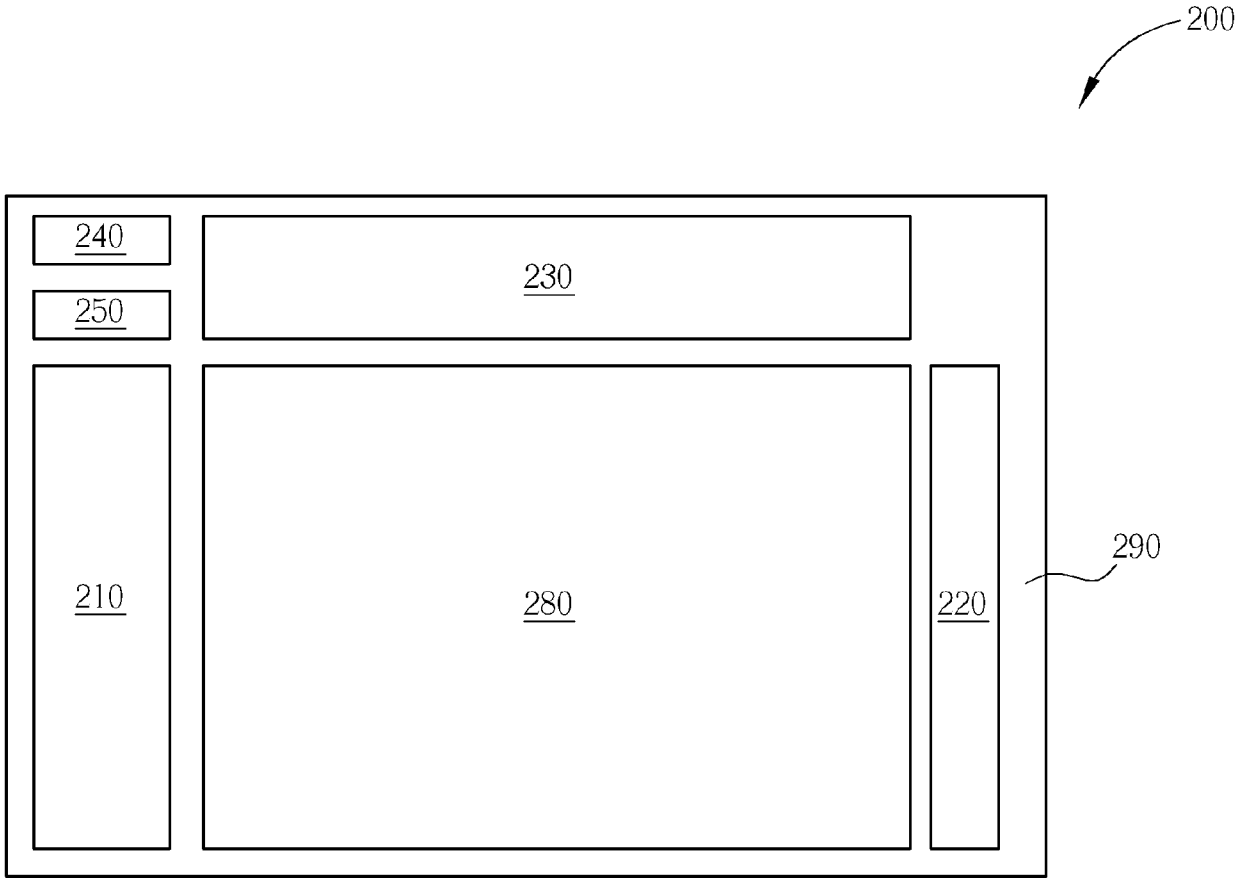
FIG. 4 is a top-view diagram of an LCD device according to the present invention.

Reference is made to FIG. 4 for a top-view diagram of an LCD device 200 according to the present invention. The LCD device 200, fabricated using GOA technique, includes a display area 280 and a non-display area 290. A first driving circuit 210, a second driving circuit 220, a source driver 230, a clock generator 240 and a power supply 250 are disposed in the non-display area 290. The first driving circuit 210 and the second driving circuit 220 are located on the opposite sides with respect to the display area 280 for driving the pixels (not shown in FIG. 4) in the display area 280 in order to display images.

Figure 5:
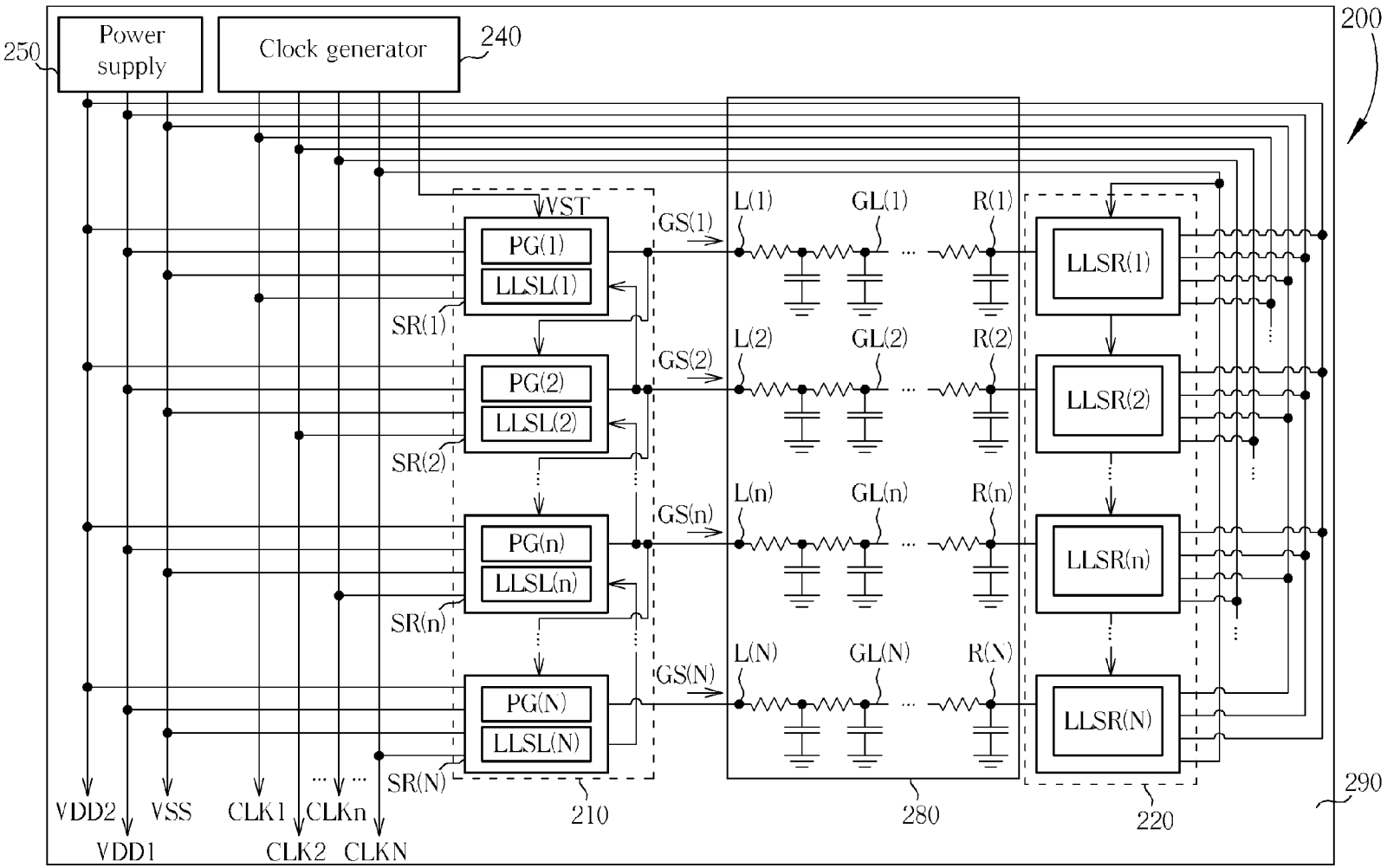
FIG. 5 is a simplified block diagram of the LCD device according to the present invention.

Reference is made to FIG. 5 for a simplified block diagram of the LCD device 200 according to the present invention. FIG. 5 merely depicts a partial structure of the LCD device 200, including a plurality of gate lines GL(1)~GL(N) disposed in the display area 280, as well as the first driving circuit 210, the second driving circuit 220, the clock generator 240 and the power supply 250 disposed in the non-display area 290. The clock generator 240 can provide a start pulse signal VST and clock signals CLK1-CLKm (m is an integer not greater than N) for operating the first driving circuit 210 and the second driving circuit 220. The power supply 250 can provide bias voltages, such as VSS, VDD1 or VDD2, for operating the first driving circuit 210 and the second driving circuit 220. The first driving circuit 210 includes a plurality of serially-coupled shift register units SR(1)-SR(N), which include pulse generators PG(1)-PG(N) and low level stabilizer LLSL(1)-LLSL(N), respectively. The output ends of the shift register units SR(1)-SR(N) are respectively coupled to the first ends L(1)-L(N) of the corresponding gate lines GL(1)-GL(N). The second driving circuit 220 includes a plurality of low level stabilizer LLSR(1)-LLSR(N) respectively coupled to the second ends R(1)-R(N) of the corresponding gate lines GL(1)-GL(N).

Figure 6:
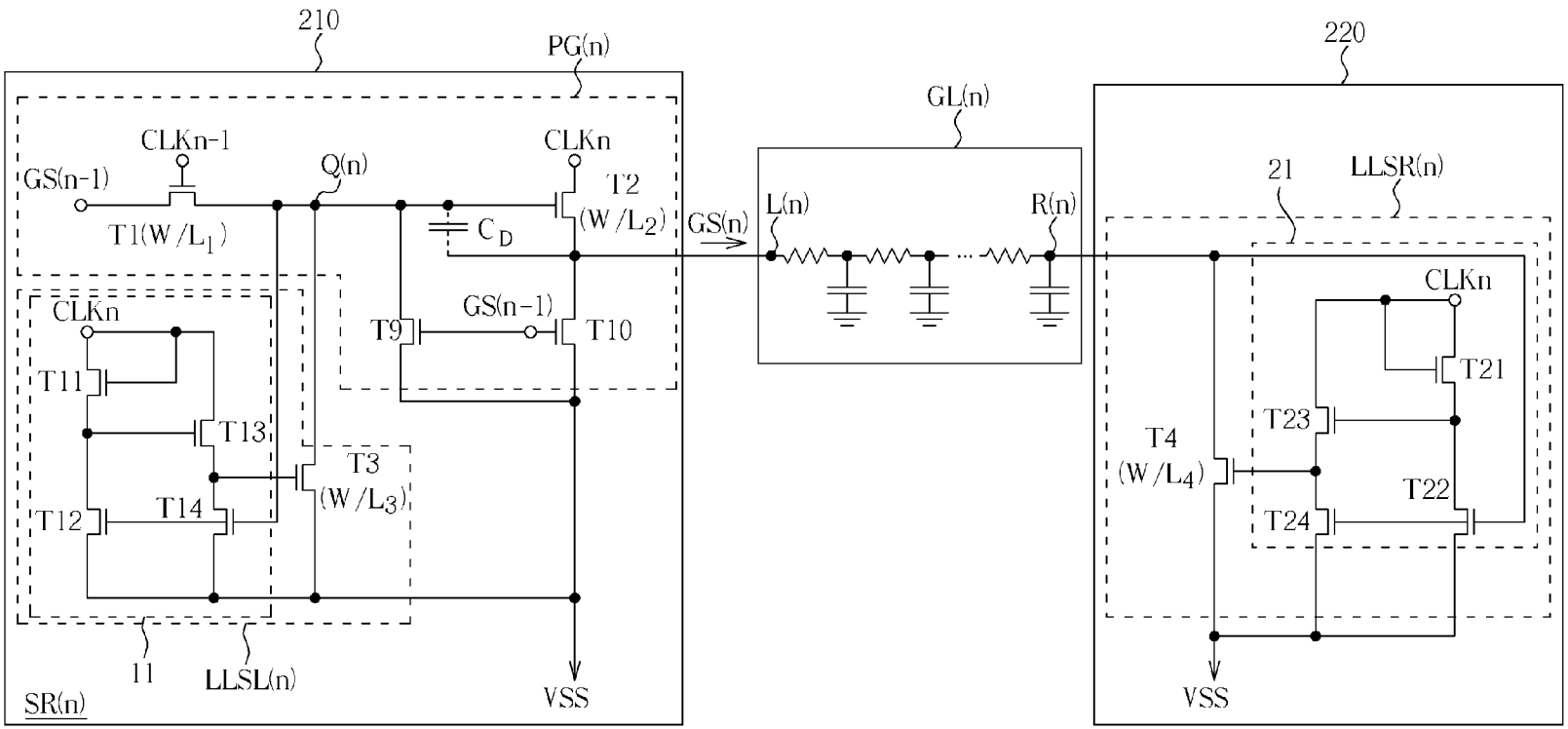
FIG. 6 is a diagram illustrating the nth-stage output of the LCD device according to a first embodiment of the present invention.

Reference is made to FIG. 6 for a diagram illustrating the nth-stage output of the LCD device 200 according to a first embodiment of the present invention. FIG. 6 shows an nth-stage shift register unit SR(n) among the plurality of shift register units SR(1)-SR(N) in the first driving circuit 210, an nth-stage low level stabilizer LLSR(n) in the second driving circuit 220, and the gate line GL(n), wherein n is an integer between 1 and N. The shift register unit SR(n) according to the first embodiment of the present invention includes a pulse generator PG (n) and a low level stabilizer LLSL(n). The input end of the shift register unit SR(n) is coupled to the output end of a prior-stage shift register unit SR(n−1). The output end of the shift register unit SR(n) is coupled to the first end L(n) of the gate line GL(n).

The pulse generators PG(n), including transistors T1, T2, T9 and T10, can generate the gate driving signal GS(n) based on the clock signal CLKn and the gate driving signal GS(n−1) transmitted from the prior-stage shift register unit SR(n−1). The low level stabilizer LLSL(n) includes transistors T3 and T11-T14. The transistors T11-T14 form a pull-down control circuit 11 which can output control signals to the gate of the transistor T3 based on the clock signal CLKn and the voltage level of the node Q(n). The transistor T3 can thus control the signal transmission path between the node Q(n) and the low-level bias voltage VSS based on its gate voltage. The low level stabilizer LLSR(n) includes transistors T4 and T21-T24. The transistors T21-T24 form a pull-down control circuit 21 which can output control signals to the gate of the transistor T4 based on the clock signal CLKn and the voltage level at the second end R(n) of the gate line GL(n). The transistor T4 can thus control the signal transmission path between the second end R(n) of the gate line GL(n) and the low-level bias voltage VSS based on its gate voltage.

As shown FIGS. 4 and 6, the first driving circuit 210 and the second driving circuit 220 are disposed in the non-display area 290 and on the opposite sides with respect to the display area 280. During the output period of the shift register unit SR(n), the gate line GL(n) of the LCD device 200 receives the gate driving signal GS(n) generated by the pulse generators PG (n) at the first end L(n); during other periods excluding the output period of the shift register unit SR(n), the LCD device 200 adopts a bi-direction stabilizing structure in which the voltage level of the gate line GL(n) is maintained from both sides using the transistor T3 of the first driving circuit 210 and the transistor T4 of the second driving circuit 220, respectively. The LCD device 200 provides voltage stabilization at the first end L(n) of the gate line GL(n) using the turned-on transistor T3, thereby turning off the transistor T2 and preventing the first end L(n) of the gate line GL(n) from being influenced by the clock signal CLKn. The LCD device 200 provides voltage stabilization at the second end R(n) of the gate line GL(n) using the turned-on transistor T4, thereby pulling down the second end R(n) of the gate line GL(n) to the low-level bias voltage VSS. In other words, the gate driving signal GS(n) is maintained at the low level from the opposite side with respect to the signal input side.

As previously explained, since the pulse generator PG(n) receives the input signal using the transistor T1 and outputs the gate driving signal GS(n) for driving the gate line GL(n) using the transistor T2, the transistor T2 needs to provide much higher driving capability than the transistor T1. Since the low-level stabilizer LLSL(n) maintains the voltage level of the node Q(n) using the transistor T3 and maintains the voltage level of the entire output using the transistor T4, the transistor T4 needs to provide much higher driving capability than the transistor T3. The capacitor $C_D$ in FIG. 6 may be a parasitic capacitor of the largest transistor T1. The pull-down circuits 11 and 21 generally adopt transistors with small channel width/length ratio, which can provide sufficient driving for generating the control signals of the transistors T3 and T4. In the first embodiment of the present invention, the channel width/length ratio $W/L_1$ of the transistor T1 can be around 300, the channel width/length ratio $W/L_2$ of the transistor T2 can be around 2000, the channel width/length ratio $W/L_3$ of the transistor T3 can be around 40, and the channel width/length ratio $W/L_4$ of the transistor T4 can be around 300. However, the above-mentioned values merely illustrate the relationship between the channel width/length ratios $W/L_1$-$W/L_4$ of the transistors T1-T4, and do not limit the scope of the present invention.

As shown in FIG. 4, the non-display area around the display area includes dummy space regardless of the position of the driving circuits. In the first embodiment of the present invention, the first driving circuit 210 for pulling down the node Q(n) is disposed in the dummy space of the non-display area 290 and adjacent to a first side of the display area 280, while the second driving circuit 220 for stabilizing the gate output is disposed in the dummy space of the non-display area 290 and adjacent to a second side of the display area 280, wherein the first and second sides are two opposite sides with respect to the display area 280. Since the pulse generator PG(n) of the first driving circuit 210 adopts the output transistor T2 with high driving capability for generating the gate driving signal GS(n), the first driving circuit 210 is larger than the second driving circuit 220. However, among the transistors T3 and T4 for voltage stabilization, the transistor T4 having larger channel width/length ratio is disposed in the dummy space of the non-display area 290 and adjacent to the second side of the display area 280 in the first embodiment of the present invention. Therefore, the circuit layout area of the first driving circuit 210 can be largely reduced and rim reduction can be effectively performed on the LCD device 200.

Figure 7:
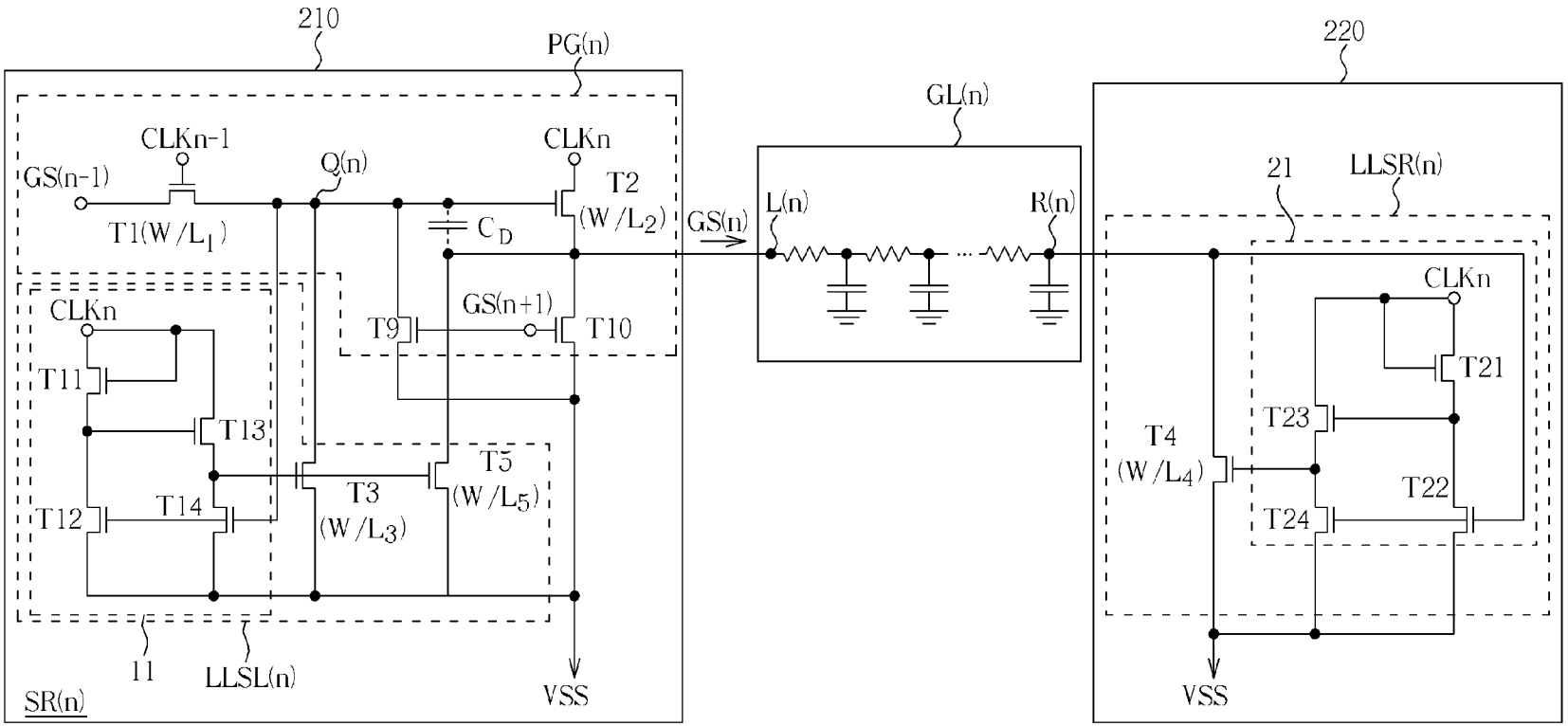
FIG. 7 is a diagram illustrating the nth-stage output of the LCD device according to a second embodiment of the present invention.

Reference is made to FIG. 7 for a diagram illustrating the nth-stage output of the LCD device 200 according to a second embodiment of the present invention. FIG. 7 shows an nth-stage shift register unit SR(n) among the plurality of shift register units SR(1)-SR(N) in the first driving circuit 210, an nth-stage low level stabilizer LLSR(n) in the second driving circuit 220, and the gate line GL(n), wherein n is an integer between 1 and N. The first and second embodiments of the present invention have similar arrangements, but differ in the structure of the low level stabilizer LLSL(n) in the first driving circuit 210. The low level stabilizer LLSL(n) according to the second embodiment of the present invention further includes a transistor T5 for controlling the signal transmission path between the first end L(n) of the gate line GL(n) and the low-level bias voltage VSS based on the control signals transmitted from the pull-down control circuit 11. During other periods excluding the output period of the shift register unit SR(n), the LCD device 200 according to the second embodiment of the present invention adopts a bi-directional stabilizing structure in which the voltage level of the gate line GL(n) is maintained from both sides of the gate line GL(n) using the transistors T3 and T5 of the first driving circuit 210 and the transistor T4 of the second driving circuit 220, respectively. The LCD device 200 according to the second embodiment of the present invention provides voltage stabilization at the first end L(n) of the gate line GL(n) using the turned-on transistor T3, thereby turning off the transistor T2 and preventing the first end L(n) of the gate line GL(n) from being influenced by the clock signal CLKn during non-output periods. The LCD device 200 according to the second embodiment of the present invention provides voltage stabilization at the second end R(n) of the gate line GL(n) using the turned-on transistor T4, thereby pulling down the second end R(n) of the gate line GL(n) to the low-level bias voltage VSS. In other words, the gate driving signal GS(n) is maintained at the low level from the opposite side with respect to the signal input side.

As shown in FIG. 4, the non-display area around the display area includes dummy space regardless of the position of the driving circuits. In the second embodiment of the present invention, the first driving circuit 210 for pulling down the node Q(n) and for stabilizing partial gate output is disposed in the dummy space of the non-display area 290 and adjacent to a first side of the display area 280, while the second driving circuit 220 for stabilizing partial gate output is disposed in the dummy space of the non-display area 290 and adjacent to a second side of the display area 280, wherein the first and second sides are two opposite sides with respect to the display area 280. Since the transistor T4 of the second driving circuit 220 can stabilize gate output from the opposite side with respect to the signal input side, the transistor T3 of the first driving circuit 210 can adopt the transistor T5 having a smaller channel width/length ratio. Therefore, the circuit layout area of the first driving circuit 210 can be largely reduced and rim reduction can be effectively performed on the LCD device 200. In the second embodiment of the present invention, the channel width/length ratio $W/L_1$ of the transistor T1 can be around 300, the channel width/length ratio $W/L_2$ of the transistor T2 can be around 2000, the channel width/length ratio $W/L_3$ of the transistor T3 can be around 40, the channel width/length ratio $W/L_4$ of the transistor T4 can be around x, and the channel width/length ratio $W/L_5$ of the transistor T5 can be around (300−x). The value of x determines the percentage of gate stabilization performed by the transistors T4 and T5. In the preferred embodiment of the present invention, x is greater than (300−x) so as to effectively minimize the circuit layout area of the first driving circuit 210. However, the above-mentioned values merely illustrate the relationship between the channel width/length ratios $W/L_1$-$W/L_5$ of the transistors T1-T5, and do not limit the scope of the present invention.

Figure 8:
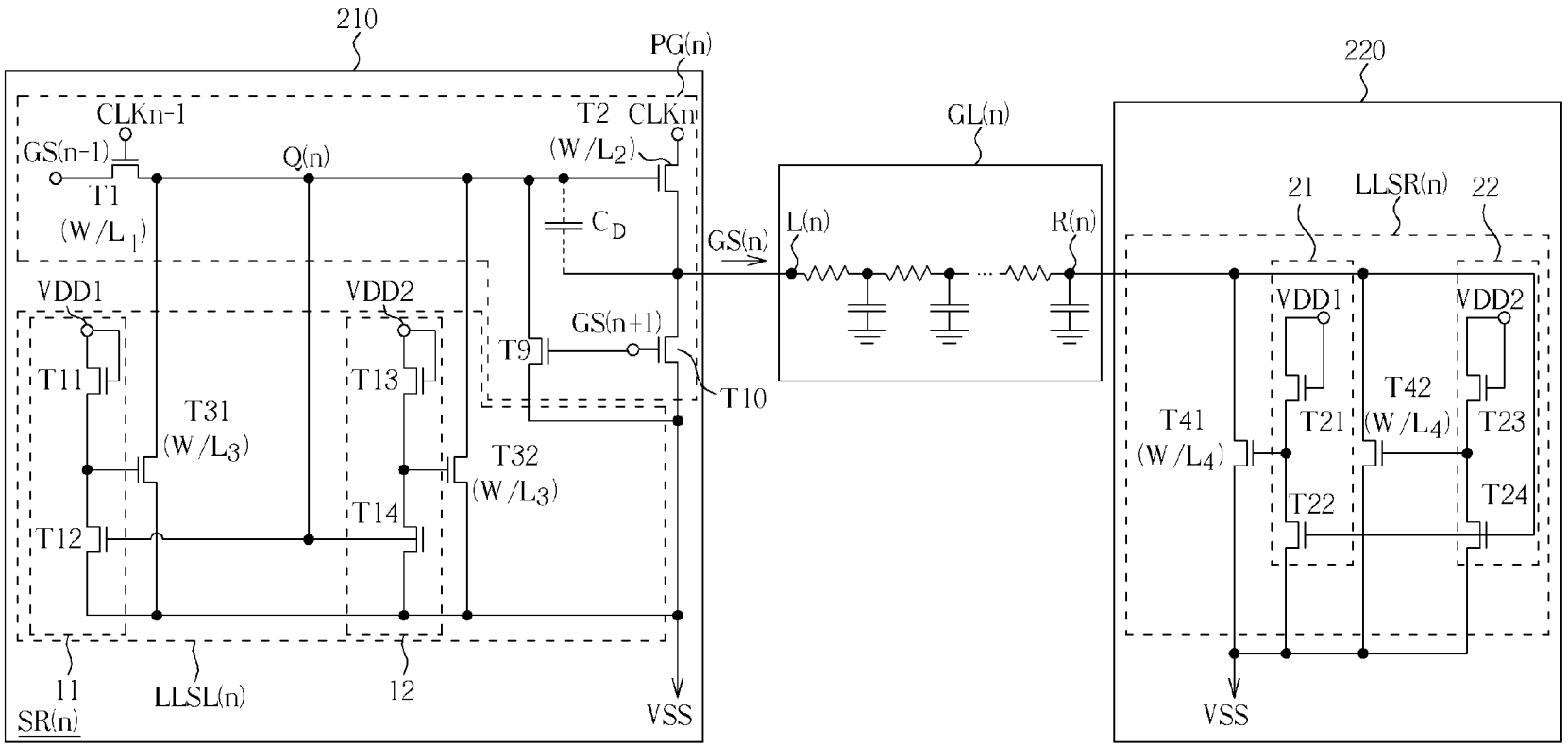
FIG. 8 is a diagram illustrating the nth-stage output of the LCD device according to a third embodiment of the present invention.

Reference is made to FIG. 8 for a diagram illustrating the nth-stage output of the LCD device 200 according to a third embodiment of the present invention. FIG. 8 shows an nth-stage shift register unit SR(n) among the plurality of shift register units SR(1)-SR(N) in the first driving circuit 210, an nth-stage low level stabilizer LLSR(n) in the second driving circuit 220, and the gate line GL(n), wherein n is an integer between 1 and N. The first and third embodiments of the present invention have similar arrangement, but differ in the structures of the low level stabilizer LLSL(n) in the first driving circuit 210 and the low level stabilizer LLSR(n) in the second driving circuit 220. The low level stabilizer LLSL(n) according to the third embodiment of the present invention includes transistors T31, T32 and T11-T14. The transistors T11 and T12 form a pull-down control circuit 11 which can output control signals to the gate of the transistor T31 based on the voltage VDD1 and the voltage level of the node Q(n). The transistor T31 can thus control the signal transmission path between the node Q(n) and the low-level bias voltage VSS based on its gate voltage. The low level stabilizer LLSR (n) according to the third embodiment of the present invention includes transistors T41, T42 and T21-T24. The transistors T21 and T22 form a pull-down control circuit 21 which can output control signals to the gate of the transistor T41 based on the voltage VDD1 and the voltage level of the second end R(n) of the gate line GL(n). The transistor T41 can thus control the signal transmission path between the second end R(n) of the gate line GL(n) and the low-level bias voltage VSS based on its gate voltage. The transistors T23 and T24 form a pull-down control circuit 22 which can output control signals to the gate of the transistor T42 based on the voltage VDD2 and the voltage level of the second end R(n) of the gate line GL(n). The transistor T42 can thus control the signal transmission path between the second end R(n) of the gate line GL(n) and the low-level bias voltage VSS based on its gate voltage.

During other periods excluding the output period of the shift register unit SR(n), the voltage level of the gate line GL(n) in the third embodiment is maintained from both sides of the gate line GL(n) using the transistors T31 and T32 of the first driving circuit 210 and the transistors T41 and T42 of the second driving circuit 220. The LCD device 200 according to the third embodiment of the present invention provides voltage stabilization at the first end L(n) of the gate line GL(n) using the turned-on transistor T31 or T32, thereby turning off the transistor T2 and preventing the first end L(n) of the gate line GL(n) from being influenced by the clock signal CLKn during non-output periods. The LCD device 200 according to the third embodiment of the present invention provides voltage stabilization at the second end R(n) of the gate line GL(n) using the turned-on transistor T41 or T42, thereby pulling down the second end R(n) of the gate line GL(n) to the low-level bias voltage VSS. In other words, the gate driving signal GS(n) is maintained at the low level from the opposite side with respect to the signal input side.

In the third embodiment of the present invention, since the pulse generator PG(n) receives the input signal using the transistor T1 and outputs the gate driving signal GS(n) for driving the gate line GL(n) using the transistor T2, the transistor T2 needs to provide much higher driving capability than the transistor T1. Since the low-level stabilizer LLSL(n) maintains the voltage level of the node Q(n) using the transistor T31 or T41 and the low-level stabilizer LLSR(n) maintains the voltage level of the entire output using the transistor T41 or T42, the transistors T41 and T42 need to provide much higher driving capability than the transistors T31 and T32. The pull-down circuits 11, 12, 21 and 22 generally adopt transistors with small channel width/length ratio, which can provide sufficient driving for generating the control signals of the transistors T31, T32, T41 and T42. In the third embodiment of the present invention, the channel width/length ratio $W/L_1$ of the transistor T1 can be around 300, the channel width/length ratio $W/L_2$ of the transistor T2 can be around 2000, the channel width/length ratio $W/L_3$ of the transistors T31 and T32 can be around 40, and the channel width/length ratio $W/L_4$ of the transistors T41 and T42 can be around 300. However, the above-mentioned values merely illustrate the relationship between the channel width/length ratios $W/L_1$-$W/L_4$ of the transistors T1, T2, T31, T32, T41 and T42, and do not limit the scope of the present invention.

As shown in FIG. 4, the non-display area around the display area includes dummy space regardless of the position of the driving circuits. In the third embodiment of the present invention, the first driving circuit 210 for pulling down the node Q(n) is disposed in the dummy space of the non-display area 290 and adjacent to a first side of the display area 280, while the second driving circuit 220 for stabilizing the gate output is disposed in the dummy space of the non-display area 290 and adjacent to a second side of the display area 280, wherein the first and second sides are two opposite sides with respect to the display area 280. Since the pulse generator PG(n) of the first driving circuit 210 adopts the output transistor T2 for generating the output driving signal GS(n), the first driving circuit 210 is larger than the second driving circuit 220. However, among the transistors T31, T32, T41 and T42 for voltage stabilization, the transistors T41 and T42 having larger channel width/length ratios are disposed in the dummy space of the non-display area 290 and adjacent to the second side of the display area 280 in the third embodiment of the present invention. Therefore, the circuit layout area of the first driving circuit 210 can be largely reduced and rim reduction can be effectively performed on the LCD device 200.

Figure 9:
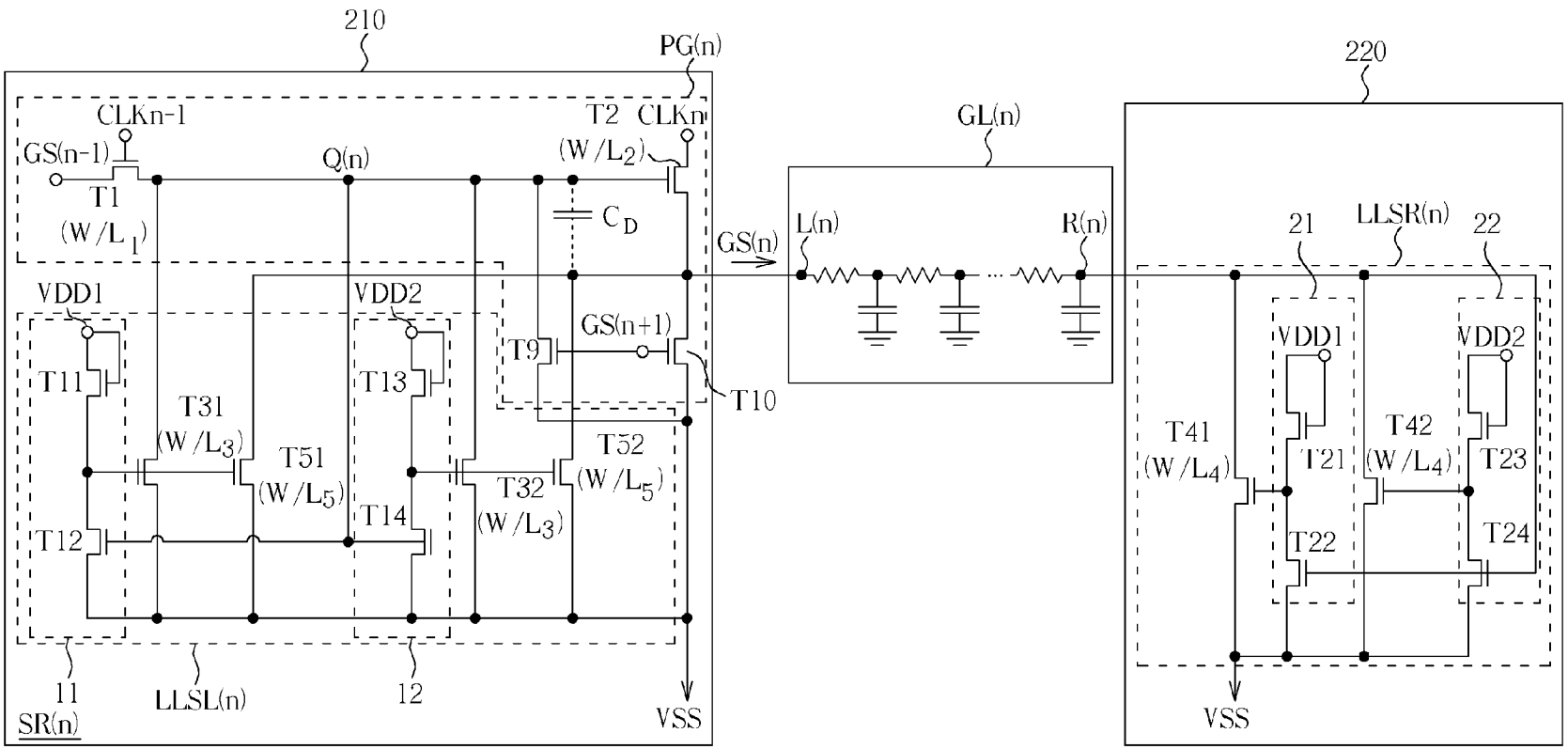
FIG. 9 is a diagram illustrating the nth-stage output of the LCD device according to a fourth embodiment of the present invention.

Reference is made to FIG. 9 for a diagram illustrating the nth-stage output of the LCD device 200 according to a fourth embodiment of the present invention. FIG. 9 shows an nth-stage shift register unit SR(n) among the plurality of shift register units SR(1)-SR(N) in the first driving circuit 210, an nth-stage low level stabilizer LLSR(n) in the second driving circuit 220, and the gate line GL(n), wherein n is an integer between 1 and N. The third and fourth embodiments of the present invention have similar arrangements, but differ in the structure of the low level stabilizer LLSL(n) in the first driving circuit 210. The low level stabilizer LLSL(n) according to the fourth embodiment of the present invention further includes transistors T51 and T52 for controlling the signal transmission path between the first end L(n) of the gate line GL(n) and the low-level bias voltage VSS based on the control signals respectively transmitted from the pull-down control circuits 11 and 12. During other periods excluding the output period of the shift register unit SR(n), the LCD device 200 according to the fourth embodiment of the invention adopts a bi-direction voltage stabilization mechanism in which the voltage level of the gate line GL(n) is maintained from both sides using the transistor T31, T32, T51 or T52 of the first driving circuit 210 and the transistor T41 or T42 of the second driving circuit 220. The LCD device 200 according to the fourth embodiment of the present invention provides voltage stabilization at the first end L(n) of the gate line GL(n) using the turned-on transistor T31 or T32, thereby turning off the transistor T2 and preventing the first end L(n) of the gate line GL(n) from being influenced by the clock signal CLKn during non-output periods. Meanwhile, the first end L(n) of the gate line GL(n) is pulled down to the low voltage level VSS using the turned-on transistor T51 or T52. In other words, the gate driving signal GS(n) is maintained at the low level from the signal input side. The LCD device 200 according to the fourth embodiment of the present invention provides voltage stabilization at the second end R(n) of the gate line GL(n) via the turned-on transistor T41 or T42, thereby pulling down the second end R(n) of the gate line GL(n) to the low-level bias voltage VSS. In other words, the gate driving signal GS(n) is maintained at the low level from the opposite side with respect to the signal input side.

As shown in FIG. 4, the non-display area around the display area includes dummy space regardless of the position of the driving circuits. In the fourth embodiment of the present invention, the first driving circuit 210 for pulling down the node Q(n) and for stabilizing partial gate output is disposed in the dummy space of the non-display area 290 and adjacent to a first side of the display area 280, while the second driving circuit 220 for stabilizing partial gate output is disposed in the dummy space of the non-display area 290 and adjacent to a second side of the display area 280, wherein the first and second sides are two opposite sides with respect to the display area 280. Since the transistors T41 and T42 of the second driving circuit 220 can stabilize gate output from the opposite side with respect to the signal input side, the first driving circuit 210 can adopt the transistors T51 and T52 having smaller channel width/length ratio. Therefore, the circuit layout area of the first driving circuit 210 can be largely reduced and rim reduction can be effectively performed on the LCD device 200. In the fourth embodiment of the present invention, the channel width/length ratio $W/L_1$ of the transistor T1 can be around 300, the channel width/length ratio $W/L_2$ of the transistor T2 can be around 2000, the channel width/length ratio $W/L_3$ of the transistors T31 and T32 can be around 40, the channel width/length ratio $W/L_4$ of the transistors T41 and T42 can be around x, and the channel width/length ratio $W/L_5$ of the transistors T51 and T52 can be around (300−x). The value of x determines the percentage of gate stabilization performed by the transistors T41, T42, T51 and T52. In the preferred embodiment of the present invention, x is greater than (300−x) so as to effectively minimize the circuit layout area of the first driving circuit 210. However, the above-mentioned values merely illustrate the relationship between the channel width/length ratios $W/L_1$-$W/L_5$ of the transistors T1, T2, T31, T32, T41, T42, T51 and T52, and do not limit the scope of the present invention.

The transistors mentioned in the embodiments of the present invention can be thin film transistor (TFT) switches or other devices providing similar function.

Figure 10:
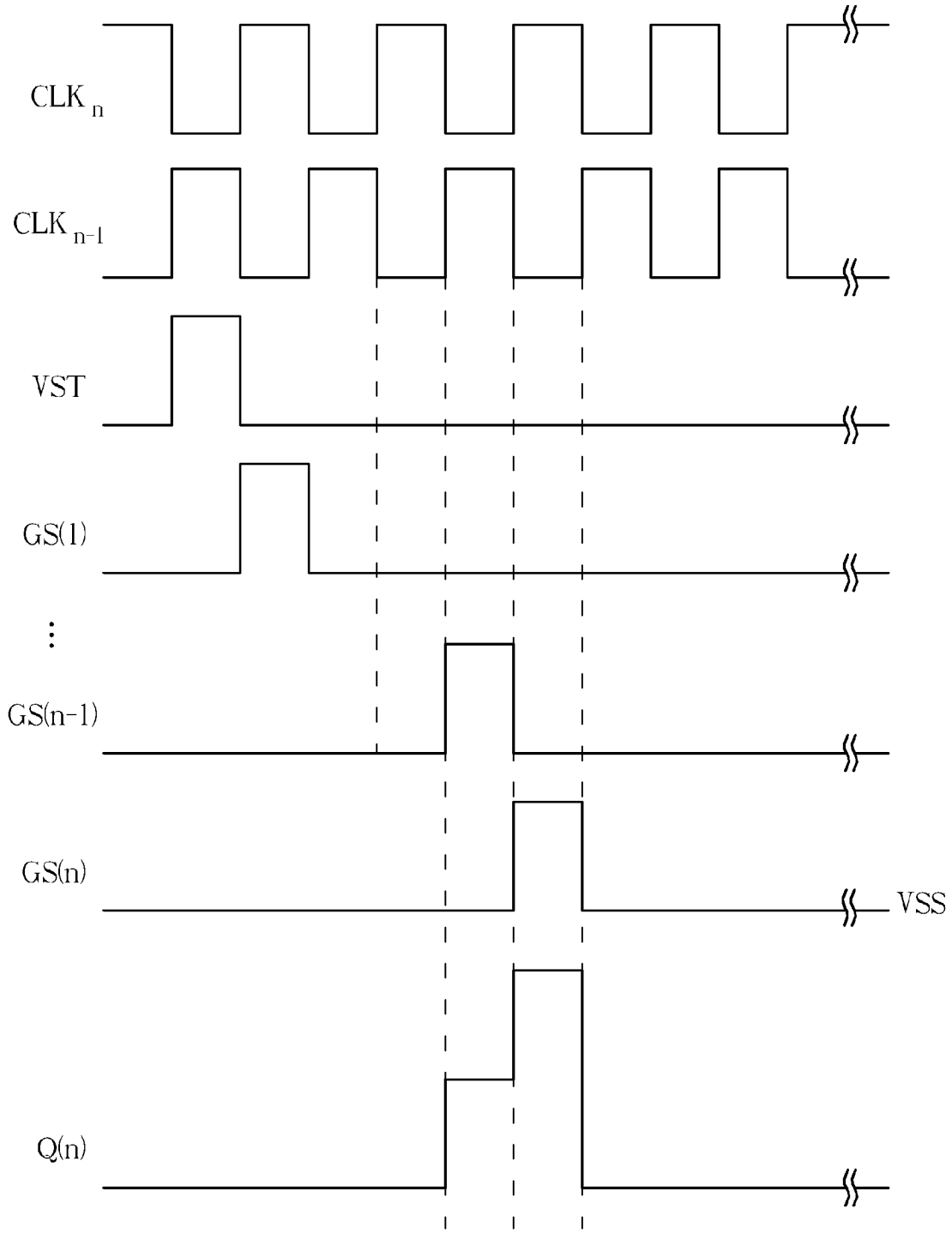
FIG. 10 is an exemplary timing diagram illustrating the operations of the LCD device according to the embodiments of the present invention.

Reference is made to FIG. 10 for an exemplary timing diagram illustrating the operations of the LCD device 200 according to the embodiments of the present invention. FIG. 10 depicts the waveforms of the clock signals CLKn and CLKn−1, the start pulse signal VST, the gate driving signals GS(1)-GS(n), and the node Q(n).

The present invention provides an LCD device having bi-directional voltage stabilization mechanism. The driving circuits are disposed in the dummy space of the non-display area and on two opposite sides with respect to the display area. Therefore, the circuit layout area on the signal input side can largely be reduced and rim reduction can be effectively performed.

Those skilled in the art will readily observe that numerous modifications and alterations of the device and method may be made while retaining the teachings of the invention.

What is claimed is:

1. An LCD device providing bi-directional stabilization comprising:

a display area in which a plurality of parallel gate lines are disposed;

a non-display area having a first area and a second area, wherein the first and second areas are located on opposite sides with respect to the display area;

a shift register having a plurality of shift register units coupled in series, wherein a shift register among the plurality of shift register drives a corresponding gate line among the plurality of gate lines and comprises:

a first circuit disposed in the first area and comprising:

a pulse generator for generating a driving signal based on an input signal, the pulse generator comprising:

an input end for receiving the input signal;

an output end coupled to a first end of the corresponding gate line for outputting the driving signal; and a node;

a first transistor having a first channel width/length ratio for maintaining a voltage level of the node based on a first control signal, the first transistor comprising:

a first end coupled to the node;

a second end for receiving a first voltage; and a control end for receiving the first control signal; and a second circuit disposed in the second area and comprising:

a second transistor having a second channel width/length ratio for maintaining a voltage level at a second end of the corresponding gate line based on a second control signal, the second transistor comprising:

a first end coupled to the second end of the corresponding gate line;

a second end for receiving a second voltage; and a control end for receiving the second control signal;

wherein the first channel width/length ratio is smaller than the second channel width/length ratio and the layout area of the first circuit is larger than the layout area of the second circuit.

2. The LCD device of claim 1, wherein:

the first circuit further comprises a first control circuit coupled to the control end of the first transistor for generating the first control signal; and the second circuit further comprises a second control circuit coupled to the control end of the second transistor for generating the second control signal.

3. The LCD device of claim 2, wherein the first control circuit includes a third transistor having a third channel width/length ratio, the second control circuit includes a fourth transistor having a fourth channel width/length ratio, and the third and fourth channel width/length ratios are both smaller than the second channel width/length ratio.

4. The LCD device of claim 1, wherein the first circuit further comprises:

a fifth transistor having a fifth channel width/length ratio comprising:

a first end coupled to the first end of the corresponding gate line;

a second end for receiving a third voltage; and a control end for receiving a third control signal;

wherein the fifth channel width/length ratio is smaller than the second channel width/length ratio.

5. The LCD device of claim 4, wherein the shift register unit further comprises:

a first control circuit coupled to the control ends of the first and fifth transistors for generating the first and third control signals; and a second control circuit coupled to the control end of the second transistor for generating the second control signal.

6. The LCD device of claim 4 wherein the first and third voltages have the same voltage level.

7. The LCD device of claim 1, wherein the pulse generator further comprises:

a sixth transistor comprising:

a first end coupled to the input end of the pulse generator;

a second end coupled to the node; and a control end;

a seventh transistor comprising:

a first end for receiving a clock signal;

a second end coupled to the output end of the pulse generator; and a control end coupled to the node;

an eighth transistor comprising:

a first end coupled to the output end of the pulse generator;

a second end for receiving the first voltage; and a control end for receiving a driving signal generated by a next-stage shift register unit; and a capacitor coupled between the node and the output end of the pulse generator.

8. The LCD device of claim 7 wherein the control end of the sixth transistor is coupled to the first end of the sixth transistor.

9. The LCD device of claim 1 wherein the first and second voltages have the same voltage level.

10. The LCD device of claim 1 wherein the input end of the pulse generator is coupled to a prior-stage shift register unit for receiving the input signal.

11. A shift register which provides bi-directional stabilization and includes a plurality of shift register units coupled in series for driving a plurality of loads, wherein a shift register among the plurality of shift register comprises:

a first circuit disposed in the first area and comprising:

a pulse generator for generating a driving signal based on an input signal, the pulse generator comprising:

an input end for receiving the input signal;

an output end coupled to a first end of a corresponding load among the plurality of loads for outputting the driving signal; and a node;

a first transistor having a first channel width/length ratio for maintaining a voltage level of the node based on a first control signal, the first transistor comprising:

a first end coupled to the node;

a second end for receiving a first voltage; and a control end for receiving the first control signal; and a second circuit disposed in the second area and comprising:

a second transistor having a second channel width/length ratio for maintaining a voltage level at a second end of the corresponding load based on a second control signal, the second transistor comprising:

a first end coupled to the second end of the corresponding load;

a second end for receiving a second voltage; and a control end for receiving the second control signal;

wherein the first channel width/length ratio is smaller than the second channel width/length ratio and the layout area of the first circuit is larger than the layout area of the second circuit.

12. The shift register of claim 11, wherein:

the first circuit further comprises a first control circuit coupled to the control end of the first transistor for generating the first control signal; and the second circuit further comprises a second control circuit coupled to the control end of the second transistor for generating the second control signal.

13. The shift register of claim 12, wherein the first control circuit includes a third transistor having a third channel width/length ratio, the second control circuit includes a fourth transistor having a fourth channel width/length ratio, and the third and fourth channel width/length ratios are both smaller than the second channel width/length ratio.

14. The shift register of claim 11, wherein the first circuit further comprises:

a fifth transistor having a fifth channel width/length ratio for maintaining the voltage level of the first side of the load based on a third control signal, the fifth transistor comprising:

a first end coupled to the first end of the corresponding gate line;

a second end for receiving a third voltage; and a control end for receiving the third control signal;

wherein the fifth channel width/length ratio is smaller than the second channel width/length ratio.

15. The shift register of claim 14, wherein the shift register unit further comprises:

a first control circuit coupled to the control ends of the first and fifth transistors for generating the first and third control signals; and a second control circuit coupled to the control end of the second transistor for generating the second control signal.

16. The shift register of claim 14 wherein the first and third voltages have the same voltage level.

17. The shift register of claim 11, wherein the pulse generator further comprises:

a sixth transistor comprising:

a first end for receiving the input signal;

a second end coupled to the node; and a control end;

a seventh transistor comprising:

a first end for receiving a clock signal;

a second end coupled to the output end of the pulse generator; and a control end coupled to the node;

an eighth transistor comprising:

a first end coupled to the output end of the pulse generator;

a second end for receiving the first voltage; and a control end for receiving a driving signal generated by a next-stage shift register unit; and a capacitor coupled between the node and the output end of the pulse generator.

18. The shift register of claim 17 wherein the control end of the sixth transistor is coupled to the first end of the sixth transistor.

19. The shift register of claim 11 wherein the first and second voltages have the same voltage level.

20. The shift register of claim 11 wherein the input end of the pulse generator is coupled to a prior-stage shift register unit for receiving the input signal.

* * * * *